United States Patent [19]

Berg

[11] 4,027,444

[45] June 7, 1977

[54] FIRE-RESISTANT WALLS FOR USE IN SHIPBUILDING

[76] Inventor: Adolf Berg, Niendorfer Hohe 9, 2000 Hamburg 61, Germany

[22] Filed: Dec. 17, 1975

[21] Appl. No.: 641,556

Related U.S. Application Data

[63] Continuation of Ser. No. 515,981, Oct. 18, 1974, abandoned.

[30] Foreign Application Priority Data

Oct. 19, 1973 Germany ..... 2352444

[52] U.S. Cl. ..... 52/240; 52/243; 52/281

[51] Int. Cl.[2] ..... E04H 1/00

[58] Field of Search ..... 52/243, 281, 282, 481, 52/240

[56] References Cited

UNITED STATES PATENTS

| | | | |
|---|---|---|---|
| 2,910,739 | 11/1959 | Snitker | 52/232 X |
| 3,245,184 | 4/1966 | Halle | 52/281 |
| 3,312,025 | 4/1967 | Deakins | 52/492 X |
| 3,513,606 | 5/1970 | Jones | 52/239 X |

*Primary Examiner*—Price C. Faw, Jr.
*Assistant Examiner*—Carl D. Friedman
*Attorney, Agent, or Firm*—Max Fogiel

[57] ABSTRACT

Fire-retardant walls composed of construction elements, especially for use in shipbuilding, in which wall plates have each two covering panels. One or several fire-retardant layers are located between the two covering panels. The vertical edges of the covering panels are shaped into profiles and provided with slits for the insertion of hooks located on vertical supports.

6 Claims, 5 Drawing Figures

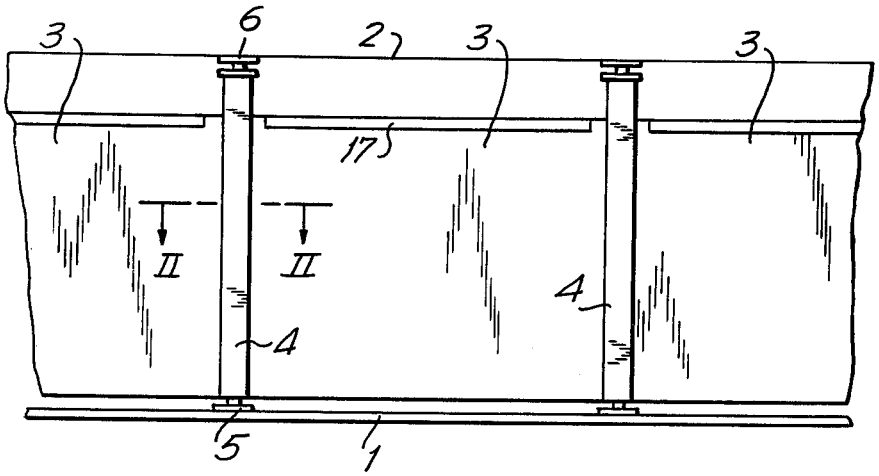
FIG. 1
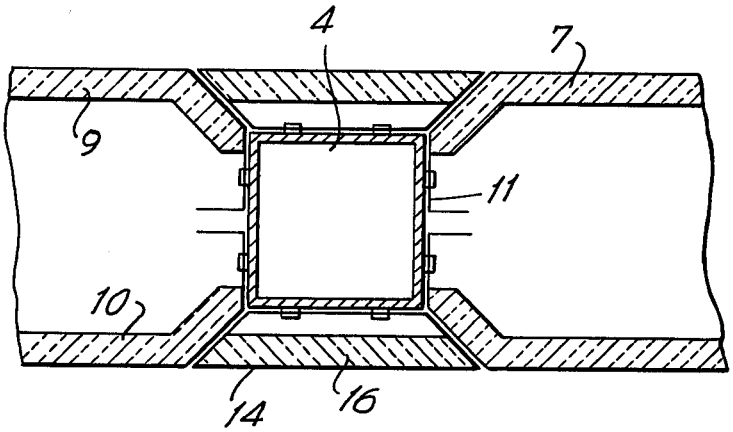
FIG. 2
FIG. 3
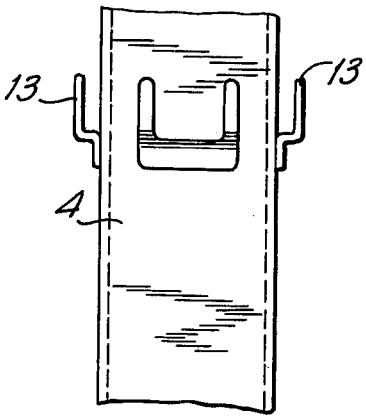
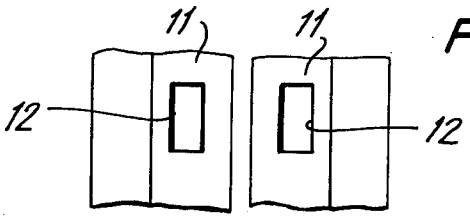
FIG. 4
FIG. 5
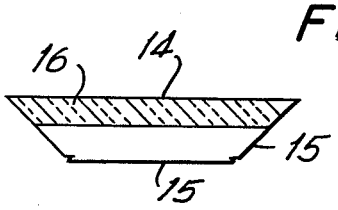

FIRE-RESISTANT WALLS FOR USE IN SHIPBUILDING

The present application is a continuation of the parent application Ser. No. 515,981, filed Oct. 18, 1974, now abandoned.

BACKGROUND OF THE INVENTION

The present invention relates to fire-retardant walls composed of construction elements, especially for use in shipbuilding. It is already known in the art, how to provide rooms on board ships between two decks by means of prefabricated wall or ceiling sections, by using special frame construction.

In this known or conventional form of construction, special sections or profiles are used in dovetail form with projections serving as supporting structures on both sides. In the area of one projection, a tongue is provided which serves as reference edge for the floor covering to be laid.

In this construction method, already when erecting the walls which abut at an angle of 90°, several special profiles must be connected with one another to obtain some sort of support. But it is particularly difficult to erect adjoining walls when they abut at an arbitrary angle. For this reason, the walls to be erected in accordance with the known construction method are very expensive, and the floor covering can only be laid after the walls have been installed.

It is, therefore, an object of the present invention to create a fire-retardant wall composed of construction elements, especially for use in shipbuilding, which is easily erected and has many applications and a relatively low weight, without being tied to special profiles, so that the spacing can always be kept uniform.

Another object of the present invention is to provide a fire-retardant wall arrangement which can be economically fabricated and assembled.

A still further object of the present invention is to provide a fire-resistant wall arrangement of the foregoing character which may be easily cleaned and maintained.

SUMMARY OF THE INVENTION

The objects of the present invention are achieved as follows: Each wall plate consists of two covering panels between which one or several fire-retardant layers are located. The vertical edges of the covering panels are formed into profiles and provided with slits for accommodating hooks located on vertical supports.

Since, in accordance with the present invention, the vertical support is a multi-cornered pipe and each edge surface is provided with a number of hooks, the erection of a wall-is extremely simple and independent of the angle at which adjacent walls abut. In addition, for erecting the walls, only a wrench is necessary in order to tighten the grip-spring tensioning elements. Welding or similar work is not necessary. Since the walls can be erected on the already laid floor-covering, considerable noise-damping occurs.

The clamping of the vertical supports is accomplished by already known grip-spring tensioning elements with at least one element being equipped with a spring in order to permit small movements.

Another simplification of the present invention in comparison with the known construction method with special profiles, is that the cover plates being used are placed on bearing plates, without using additional construction elements. These bearing plates are located in the area of the upper horizontal edge of each upper wall section.

In order to cover the free edge surfaces of the vertical supports, there are provided profile rails open at one side which are arranged similarly to the wall sections on hooks on the supports. These free surfaces of the supports can also be used for suspending furniture or such items. The height of these profile rails is chosen so that they are in one plane with the outer surface of the wall sections.

It has been found to be very advantageous to also coat the profile rails with fire-retardant material, and to coat the abutting edges of the individual construction elements with a material which forms foam when exposed to heat.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is an elevational view and shows a wall assembled from construction elements, in accordance with the present invention;

FIG. 2 shows a section taken along line II—II of FIG. 1;

FIG. 3 is a partial elevational view of a vertical support;

FIG. 4 is a partial view of the vertical edge of a wall section; and

FIG. 5 is a top view of a cover profile rail, in accordance with the present invention.

DESCRIPTION OF THE PREFERRED EMBODIMENTS

Referring to FIG. 1, there is shown a wall erected between two decks 1 and 2. This wall is composed of wall sections 3 and supports 4, with supports 4 being clamped between the two decks 1 and 2 by conventional grip-spring elements 5 and 6. Of the grip-spring elements 5 and 6 being used, at least one, with the form of construction of element 5, is equipped with a spring so that small movements can be absorbed.

Wall sections 3 consist of two covering panels 7 and 8, between which fire-retardant layers 9 and 10 are placed. The vertical edges 11 of these wall sections 3 are formed into profiles and provided with slits 12 with which the hooks 13 of the vertical support mate.

Each vertical support 4 is a multi-cornered pipe. In the embodiment shown, there is a four-corner pipe construction. To each of these surfaces, hooks 13 are attached or pushed out from the wall, which mate with slits 13 of wall sections 3.

If, as shown in FIG. 2, wall sections 3 are located in only one plane, the free surfaces of support 4 are covered by profile rails 14. These profile rails 14 are formed in such a way, that the inclination of the bent legs 15 is identical with the inclination of profile edges 3. As a result there is achieved an almost jointless connection between wall sections 3 and profile rails 14. The open side of profile rails 14 is crossed by stiffeners or cross straps 15 which are located at equal intervals, such as hooks 13 on supports 4. These profile rails 14 are coated on the inside with a fire-retardant material 16.

In order to prevent the exiting and generation of smoke or other gases at the joints, the contact edges of the individual construction elements are provided with a coating which produces foam when exposed to heat.

In order to attach the cover plates, bearing plates, e.g. L-straps 17 are located in the area of the upper horizontal edge of upper wall sections 3. The cover plates are placed on top of these L-straps. As evident from FIG. 2, hexagonal or any other multi-cornered pipes can be used without any structural modification as support 4. As a result, walls can be provided at an angle of contact of 60° or any other angle. Only the inclination of profile edge 11 of wall sections 3 must be shaped accordingly.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fire-resistant wall for ships and assemblable from construction components comprising, in combination, wall plate means having two covering panels; fire-resistant means between said covering panels, said covering panels having vertical edges shaped into integral profiles and having slits; vertical support means for supporting said wall plate means, said vertical support means being substantially less in width than said wall plate means, said profile shaped vertical edges being angularly bent and directed inward toward the interior of said wall plate means for contacting directly corners of said vertical support means, said angularly directed vertical edges for contacting said vertical support means being spaced by a distance substantially equal to the width of said vertical support means; hook means on said vertical support means and inserted into said slits, said vertical support means comprising multi-cornered pipe-shaped means, each surface of said pipe-shaped means having a predetermined number of said hook means, said wall plate means being erectable at varying angles to a neighboring wall plate means, the central axis of all said wall plate means intersecting at the center point of said multi-cornered pipe-shaped means; said fire-resistant means surrounding substantially said vertical pipe-shaped means; profile rail means open on one side and covering the free edges of said vertical support means; said rail means being spaced from said vertical support means and spanning the space between angularly inward directed vertical edges of adjacent covering panels, the outer surface of said rail means being substantially flush with the outer surface of said covering panels; said rail means forming an internal space with said angularly inward directed vertical edges and said vertical support means; said fire-resistant material filling said internal space.

2. The fire-resistant wall as defined in claim 1 including grip-spring tensioning means for clamping said vertical support means between a floor and ceiling, at least one of said grip-spring tensioning means having a spring.

3. The fire-resistant wall as defined in claim 1 including cross strap means along the open sides of said profile rail means, said cross strap means engaging said hook means on said support means.

4. The fire-resistant wall as defined in claim 1 including means generating foam when exposed to heat coated on adjoining edges of said wall plate means.

5. The fire-resistant wall as defined in claim 1 including means generating foam when exposed to heat coated on said support means.

6. The fire-resistant wall as defined in claim 1 including grip-spring tensioning means for clamping said vertical support means between a floor and ceiling, at least one of said grip-spring tensioning means having a spring; cross strap means along the open sides of said profile rail means and engaging said hook means on said support means; fire-resistant material filling said internal space; and foam generating means coated on adjoining edges of said wall plate means and said support means for generating foam when exposed to heat.

* * * * *